United States Patent [19]

Wright

[11] Patent Number: 5,033,743

[45] Date of Patent: Jul. 23, 1991

[54] TRICK BALL FOR THROWING

[76] Inventor: William T. Wright, 1838 Highview Ave., Akron, Ohio 44301

[21] Appl. No.: 619,495

[22] Filed: Nov. 29, 1990

[51] Int. Cl.[5] ..... A63B 39/08

[52] U.S. Cl. ..... 273/60 B; 273/DIG. 20; 273/58 A; 273/58 K

[58] Field of Search ..... 273/58 R, 58 A, 58 B, 273/58 BA, 58 C, 58 D, 58 E, 58 F, 58 K, 60 R, 60 A, 60 B, DIG. 20, 428

[56] References Cited

U.S. PATENT DOCUMENTS 3,918,717 11/1975 Charves ..... 273/58 K 4,003,574 1/1977 MacDonald et al. ..... 273/DIG. 20

4,006,908 2/1977 Minami ..... 273/DIG. 20

4,874,169 10/1989 Litchfield ..... 273/60 R 4,930,776 6/1990 Newcomb et al. ..... 273/58 B

*Primary Examiner*—George J. Marlo

*Attorney, Agent, or Firm*—Leon Gilden

[57] ABSTRACT

A trick ball is provided with a single polar operture in tubular communication with each of a plurality of equatorial apertures which permit the ingress and egress of air when the ball is thrown. The movement of air through the apertures effects both random and predictable erratic ball movement.

5 Claims, 3 Drawing Sheets

PRIOR ART

TRICK BALL FOR THROWING

BACKGROUND OF THE INVENTION

1. Field of the Invention

The present invention relates to trick balls, and more particularly pertains to a novel device which may be used to provide amusement to ball players by introducing a predictable element into the trajectory of a thrown ball.

2. Description of the Prior Art

The use of trick balls is known in the prior art. More specifically, trick balls heretofore devised and utilized for the purpose of amusing ball players are known to consist basically of familiar, expected and obvious structural configurations, notwithstanding the myriad of designs encompassed by the crowded prior art which have been developed for the fulfillment of countless objectives and requirements.

In this respect, the trick ball according to the present invention substantially departs from the conventional concepts and designs of the prior art, and in so doing provides an apparatus primarily developed for the purpose of amusing ball players.

As such, it can be appreciated that there exists a continuing need for new and improved trick ball which can be utilized for amusement. In this regard, the present invention substantially fulfills this need.

SUMMARY OF THE INVENTION

In view of the foregoing disadvantages inherent in the known types of trick balls now present in the prior art, the present invention provides an improved ball wherein the same can be used to amuse ball players. As such, the general purpose of the present invention, which will be described subsequently in greater detail, is to provide a new and improved trick ball which has all the advantages of the prior art balls and none of the disadvantages.

To attain this, the present invention comprises a trick ball provided with a plurality of through-extending apertures which permit the ingress and egress of air when the ball is thrown. The movement of air through the apertures effects both random and predictable erratic ball movement.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trick ball which has all the advantages of the prior art trick balls and none of the disadvantages.

It is another object of the present invention to provide a new and improved trick ball which may be easily and efficiently manufactured and marketed.

It is a further object of the present invention to provide a new and improved trick ball which is of a durable and reliable construction.

An even further object of the present invention is to provide a new and improved trick ball which is susceptible of a low cost of manufacture with regard to both materials and labor, and which accordingly is then susceptible of low prices of sale to the consuming public, thereby making such trick balls economically available to the buying public.

Still yet another object of the present invention is to provide a new and improved trick ball which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
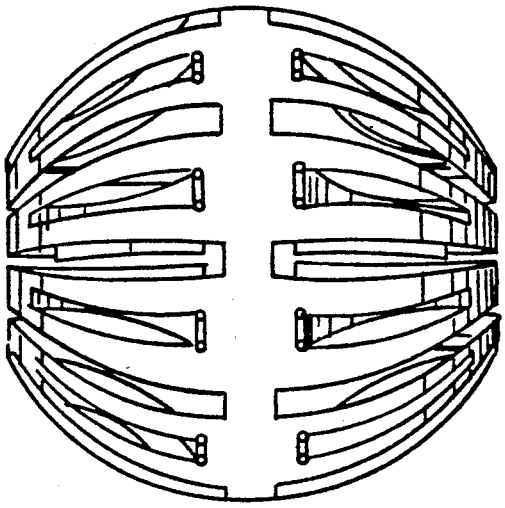
FIG. 1 is a an elevation view of an apertured ball known in the prior art.

With reference now to the drawings, and in particular to FIGS. 3-6 thereof, a new and improved trick ball embodying the principles and concepts of the present invention and generally designated by the reference numeral 10 will be described.

Figure 2:
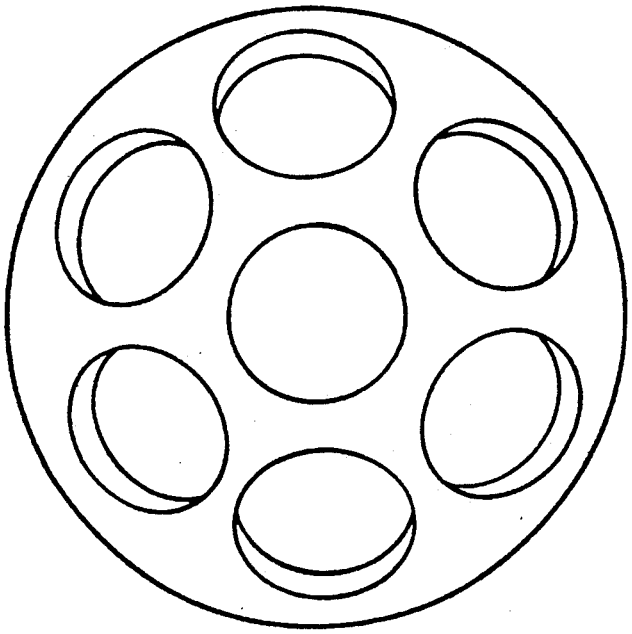
PRIOR ART FIG. 2
FIG. 2 is an elevation view of another prior art apertured ball.
Figure 3:
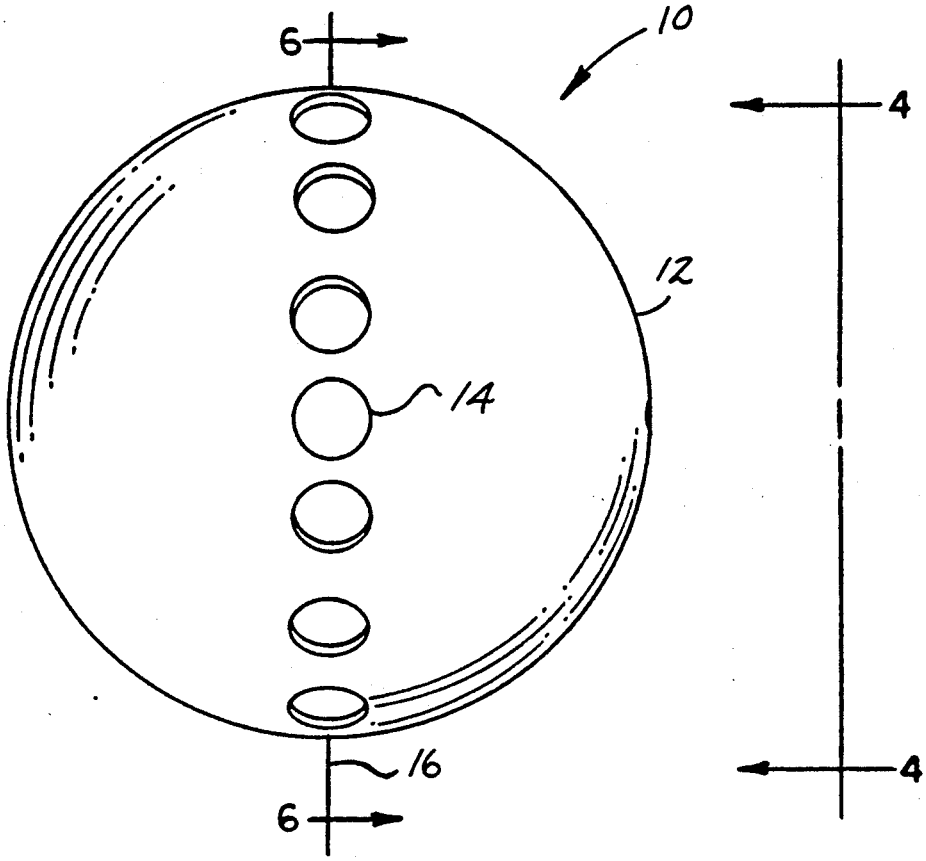
FIG. 3 is a side elevation view of the trick ball comprising the present invention.
Figure 4:
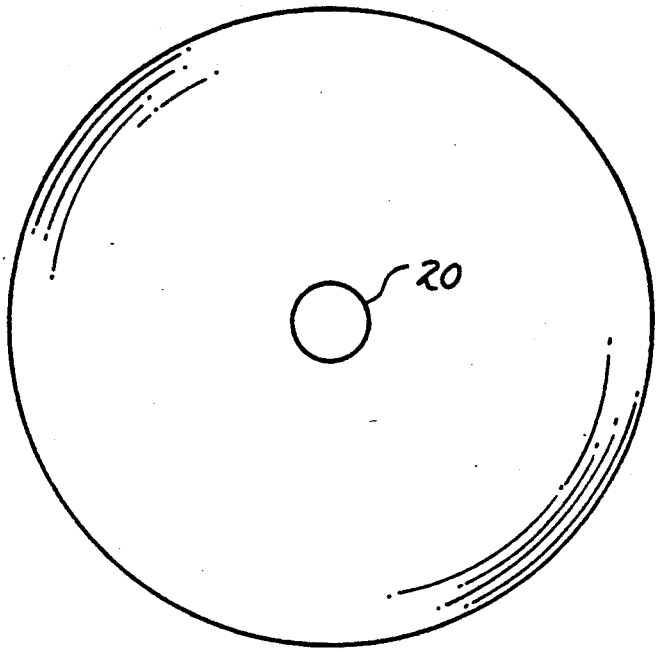
FIG. 4 is a front elevation view of the invention as viewed along the line 4—4 in FIG. 3.

Initially, reference is made to FIG. 1 and 2 of the drawings wherein known prior art apertured balls are illustrated. In this regard, FIG. 1 simply illustrates a blank for forming a spherical filling body and as such is not a trick ball. However, the FIG. 1 structure does perhaps provide sufficient teaching for constructing a ball having a plurality of through-extending air channels. The FIG. 1 structure is more specifically discussed in U.S. Pat. No. 4,581,299 which issued to R. Jager on Apr. 8, 1986.

The prior art ball of FIG. 2 is illustrative of a known type of practice golf ball which is of a hollow construction and which includes a plurality of circular apertures. This structure is more particularly illustrated in U.S. Pat. No. 4,006,908 which issued to T. Minami on Feb. 8, 1977. both these prior art structures are illustrative of the extent of knowledge now available to the public regarding apertured spherical objects and as will be below-noted, neither of these structures are remotely similar to the present invention.

Referencing FIGS. 3-6, it will be noted that the present invention 10 essentially comprises a spherical structure 12 approximately three inches in diameter. The ball 10 would preferably be constructed of a high density material that would enable it to withstand the impact of a baseball bat and respond with the resiliency of a soft ball.

The spherical structure 12 of ball 10 contains a plurality of through-extending apertures 14 equidistant on its great plane 16. Each aperture 14 is circular and approximately three eights inches in diameter. Each aperture 14 is also integrally connected through individual plastic tubes 18 at an angle of 45 degrees to a terminus opening 20 positioned 90 degrees from each aperture 14. The interior of ball 10 would preferably be filled with foam insulation 22 to stabilize the plastic tubes 18.

It has been found as a result of experiments that the rotation of the ball 10 causes air to be ingested through the single terminus opening 20 and exhausted through the twelve apertures 14 on the great plane 16 of ball 10. Therefore, when ball 10 is rotated on an axis projected through the single opening 20, it consistently curves in a predictable direction.

Figure 5:
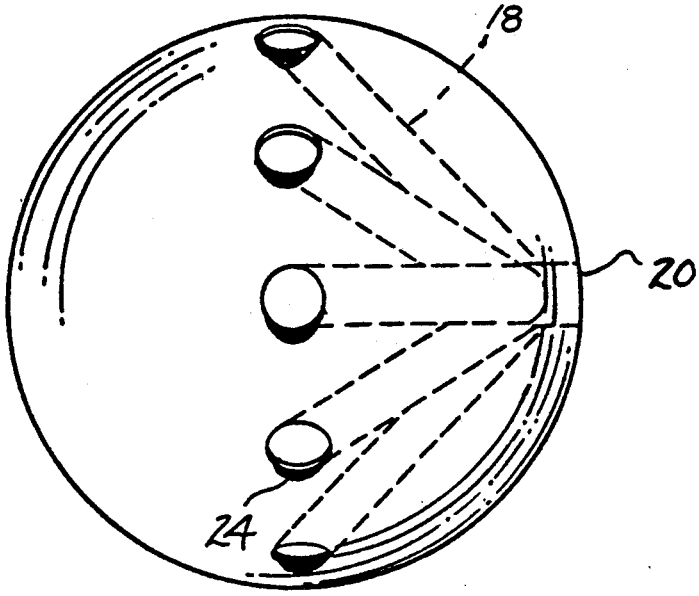
FIG. 5 is a side elevation view of the invention which more particularly illustrates the aperture channels associated therewith.
Figure 6:
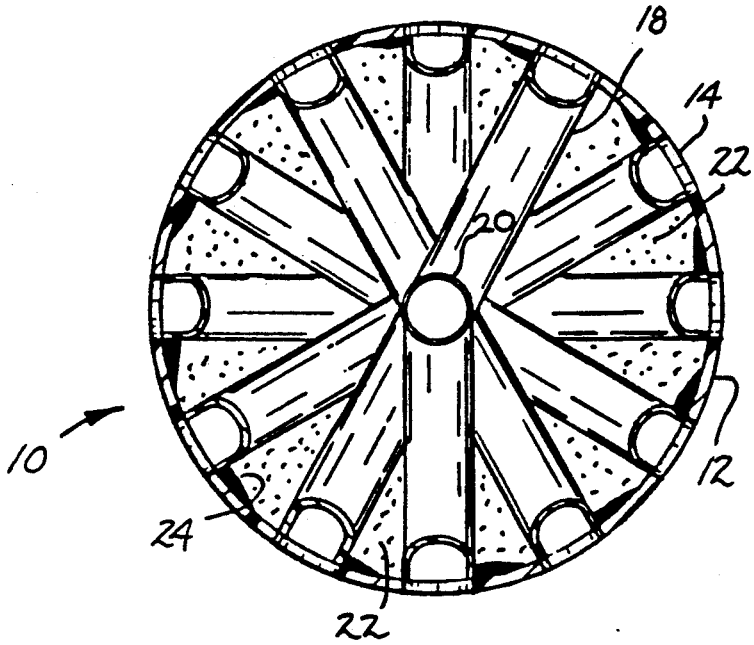
FIG. 6 is a cross-sectional view of the invention as viewed along the line 6—6 in FIG. 3.

FIGS. 5 and 6 illustrate a further feature of the invention 10 wherein air scoops 24 are beveled along one side of each aperture opening 14. The air scoops 24 are all directed in the same general direction along the great plane 16 and depending upon the amount of bevel, air egress and ingress is directionally changed to effect the amount of ball rotation. Accordingly, a greater curve may be achieved when the air scoops 24 are enlarged.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved trick ball comprising:

a hollow spherical member;

a terminus opening positioned through a wall portion of said hollow spherical member;

at least one aperture extending through said wall and being located 90 degrees around said wall from said terminus opening; and a tubular member positioned within said hollow spherical member, said tubular member extending between said terminus opening and said at least one aperture, whereby air may e directed through said tubular member when said hollow spherical member is thrown through the air.

2. The new and improved trick ball as described in claim 1, and further wherein said hollow spherical member is filled with foam insulation, said foam insulation serving to provide resiliency to said hollow spherical member and to also provide structural support to said tubular member.

3. The new and improved trick ball as described in claim 2, and further including an air scoop positioned along an edge portion of said at least one aperture.

4. A new and improved trick ball comprising:

a hollow spherical member;

a terminus opening positioned through a wall portion of said hollow spherical member;

a plurality a apertures positioned around a periphery of said hollow spherical member, said apertures extending through said wall of said hollow spherical member, said apertures being positioned equidistant around a great plane of said hollow spherical member and further being located 90 degrees around said wall from said terminus opening; and a plurality of tubular members positioned within said hollow spherical member, each of said tubular members having first ends thereof in communication with said terminus opening, and second ends of each respective tubular member being in communication with each of said respective apertures extending through said wall.

5. The new and improved trick ball as described in claim 4 and further wherein each of said plurality of apertures is provided with an air scoop structurally positioned within said wall, each of said air scoops being directed in the same direction around said great plane of said hollow spherical member.

* * * * *